US007404619B2

(12) United States Patent
Tamai et al.

(10) Patent No.: US 7,404,619 B2
(45) Date of Patent: Jul. 29, 2008

(54) IMAGE FORMING APPARATUS

(75) Inventors: Tomohiro Tamai, Saitama (JP); Tetsuya Kaneko, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/587,612

(22) PCT Filed: Dec. 1, 2005

(86) PCT No.: PCT/JP2005/022503

§ 371 (c)(1),
(2), (4) Date: Jul. 27, 2006

(87) PCT Pub. No.: WO2006/059791

PCT Pub. Date: Jun. 8, 2006

(65) Prior Publication Data

US 2007/0165065 A1 Jul. 19, 2007

(30) Foreign Application Priority Data

Dec. 3, 2004 (JP) ..... 2004-350713

(51) Int. Cl.
*B41J 2/165* (2006.01)

(52) U.S. Cl. ..... 347/36; 347/23

(58) Field of Classification Search ..... 347/36, 347/31, 35, 100, 23
See application file for complete search history.

(56) References Cited

U.S. PATENT DOCUMENTS 5,764,253 A 6/1998 Uchikata et al.
6,075,069 A * 6/2000 Takemoto ..... 523/160
6,227,642 B1 5/2001 Hanabusa et al.
2004/0135843 A1 7/2004 Hayakawa et al.

FOREIGN PATENT DOCUMENTS

| | | |
|---|---|---|
| JP | 06-210874 | 8/1994 |
| JP | 9-104121 | 4/1997 |
| JP | 9-240021 | 9/1997 |
| JP | 2000-127439 | 5/2000 |
| JP | 2000-141704 | 5/2000 |
| JP | 2001-171148 | 6/2001 |
| JP | 2002-19153 | 1/2002 |
| JP | 2002-307705 | 10/2002 |
| JP | 2002-307720 | 10/2002 |
| JP | 2003-165236 | 6/2003 |
| JP | 2003-211706 | 7/2003 |
| JP | 2004-066554 | 3/2004 |
| JP | 2004-136550 | 5/2004 |

OTHER PUBLICATIONS

Apr. 16, 2008 European search report in connection with corresponding European patent application No. EP 05 81 4401.

* cited by examiner

*Primary Examiner*—Shih-wen Hsieh
(74) *Attorney, Agent, or Firm*—Cooper & Dunham, LLP

(57) ABSTRACT

An image forming apparatus for forming an image on a recording medium by ejecting drops of recording fluid from a recording head includes a waste tank having a space for containing waste fluid, a part for obtaining a correlation value that has a correlation to a deposited state of the waste fluid in the space within the waste tank, and a part for judging whether or not the correlation value exceeds a reference value.

11 Claims, 11 Drawing Sheets

| | WASTE INK EJECTION FREQUENCY | | | |
|---|---|---|---|---|
| | LOW ← | | | → HIGH |
| CASE C1 | 1000 | 1000 | 1000 | 1000 |
| CASE C2 | 500 | 1000 | 1300 | 1500 |

| | LOW TEMP & LOW HUMIDITY | LOW TEMP & HIGH HUMIDITY | HIGH TEMP & LOW HUMIDITY | HIGH TEMP & HIGH HUMIDITY |
|---|---|---|---|---|
| RECOVERY PROCESS RA | 0.8 | 0.6 | 1.1 | 0.9 |
| RECOVERY PROCESS RB | 1.2 | 0.9 | 1.5 | 1.2 |
| RECOVERY PROCESS RC | 1.5 | 1.3 | 1.8 | 1.4 |

IMAGE FORMING APPARATUS

TECHNICAL FIELD

The present invention generally relates to image forming apparatuses, and more particularly to an image forming apparatus that is provided with a waste tank or container for containing waste ink.

BACKGROUND ART

As image forming apparatuses such as printers, facsimile apparatuses, copying apparatuses and composite (or multi-function) apparatuses having the functions of the printer, facsimile apparatus and copying apparatus, there are the so-called ink-jet recording apparatuses which use an ink-jet recording head, for example. The ink-jet recording apparatus makes an image formation on a recording medium by ejecting ink from the ink-jet recording head onto the recording medium. The recording medium may be paper, OHP film or any suitable recording sheet onto which the ink may be adhered. The image formation includes various kinds of recording and printing of characters, images and/or photographs. In the ink-jet recording apparatus, it is essential to provide a mechanism for maintaining and recovering the performance of the ink-jet recording head.

Main functions of this mechanism for maintaining and recovering the performance of the ink-jet recording head include a cap function, an ejection recovery function and a wiping function. The cap function covers the nozzle by a sealed cap member so as to prevent the recording ink in a vicinity of the nozzle from thickening and sticking due to natural evaporation. The ejection recovery function ejects the recording ink so as to eliminate poor ink ejection caused by air bubbles or the like generated within the nozzle, and draws out the recording ink from the nozzle under suction via the cap function, so as to recover the normal ink-jet performance. The wiping function wipes off the residual recording ink which is adhered on the nozzle surface and causes irregular ink-jet performance unless removed.

By using the above described mechanism to carry out the operation of maintaining and recovering the performance of the ink-jet recording head, the recording ink that is ejected from the recording head but not used for the recording (image formation) is ejected as waste ink. Japanese Laid-Open Patent Applications No.2000-127439 and No.2003-165236 propose ink-jet recording apparatuses provided with a waste tank or container (hereinafter simply referred to as a waste tank) for containing the ejected waste ink.

A Japanese Laid-Open Patent Application No.2001-171148 proposes a waste tank that is sectioned into a plurality of sections that are respectively provided with an absorbing member, so as to reduce the frequency of replacing the absorbing member. A Japanese Laid-Open Patent Application No.2002-19153 proposes a waste tank provided with an absorbing member that is divided into a plurality of replaceable parts, so as to enable reduction of the size of the ink-jet recording apparatus.

Japanese Laid-Open Patent Applications No.2002-307720 and No.2002-307705 propose integrally providing the waste tank and an ink cartridge, so that the waste tank is replaced simultaneously as the replacement of the ink cartridge.

If the waste tank becomes full and the waste ink overflows, this ink overflow causes undesirable effects within the ink-jet recording apparatus. For this reason, a full tank detection device is generally provided to detect whether or not the waste tank has become full.

A Japanese Laid-Open Patent Application No.2004-136550 proposes a full tank detection device which determines an amount of waste ink in the absorbing member of the waste tank by taking into account a total amount of ink supplied and an amount of ink that evaporates, and calculates a reference value based on which the full tank is detected based on the amount of waste ink. A Japanese Patent No.3167475 proposes a full tank detection device which determines the amount of waste ink in the absorbing member of waste tank by taking into consideration an amount of ink that evaporates depending on time intervals at which the waste ink is supplied into the waste tank, and calculates the reference value based on which the full tank is detected based on the amount of waste ink. A Japanese Laid-Open Patent Application No.2000-141704 proposes a full tank detection device which determines the amount of waste ink in the absorbing member of the waste tank by taking into account an amount of ink that evaporates depending on a number of times a maintenance is made, and calculates the reference value based on which the full tank is detected based on the amount of waste ink.

A Japanese Laid-Open Patent Application No.2004-66554 proposes an ink-jet recording apparatus provided with a plurality of waste tanks. The full tank detection device is provided with respect to only one of the plurality of waste tanks, and the amount of waste ink in the one waste tank that is detected by the full tank detection device is accumulated as a counted value. When the counted value reaches a value corresponding to the full tank, it Is judged that all of the waste tanks are full.

On the other hand, in order to realize a high-quality recording by the ink-jet recording apparatus on plain paper, there are ink-jet recording apparatuses that use a pigment-based ink. The pigment-based ink uses an organic pigment, carbon black or the like as a coloring agent. However, unlike dyes, the pigment is water insoluble. For this reason, the pigment is normally mixed with a dispersing agent, and a dispersion process is carried out so as to obtain a water ink in which the pigment is stably dispersed in water.

Such a pigment-based ink generally has a viscosity higher than that of a dye-based ink. As a result, the pigment-based ink easily thickens, and when the thickened pigment-based ink falls directly on the absorbing member In the waste tank, the thickened pigment-based ink easily forms a deposit on the absorbing member instead of being absorbed.

Therefore, if the pigment-based ink is used in combination with the conventional waste tank that is provided with the full tank detection device, there is a problem in that the pigment-based ink may form a deposit in a vicinity of an ink receiving opening in the waste tank and cause an overflow before the absorbing member is used up, because the full tank detection device cannot detect the full waste tank caused by such a deposit. In addition, since such a deposit prevents the pigment-based ink from evenly filling the entire waste tank, there is a problem in that the pigment-based ink may overflow from the waste tank before the pigment-based ink reaches a sensor of a hardware full tank detection device, particularly when the sensor is located at a position separated from the ink receiving opening in the waste tank.

Furthermore, in the case of a software full tank detection device which detects the full tank by software, the amount of waste ink that is supplied to the waste ink is determined or calculated, and the full tank is judged by comparing the amount of waste ink that is supplied with the reference value. Hence, it is necessary to stored in advance an amount of ink that is consumed for each of various kinds of operations including the ejection of the ink to remove air bubbles in the ink, the drawing out of the ink under suction to recover the ink ejection performance and the like. As a result, there is a problem in that a relatively complex operation is required to calculate the amount of ink consumed every time each of the various kinds of operations described above is carried out, to thereby deteriorate the throughput of the ink-jet recording apparatus.

BRIEF SUMMARY

The present disclosure provides an image forming apparatus which enables detection of a deposit of waste fluid within a waste tank by a relatively simple structure, even when the recording fluid has a relatively high viscosity or easily thickens.

In an aspect of the present disclosure, an image forming apparatus for forming an image on a recording medium by ejecting drops of recording fluid from a recording head, is provided comprising a waste tank having a space for containing waste fluid; obtaining means for obtaining a correlation value that has a correlation to a deposited state of the waste fluid in the space within die waste tank; and judging means for judging whether or not the correlation value exceeds a reference value. Such image forming apparatus allows one to detect a deposit of the waste fluid within the waste tank by a relatively simple structure, even when the recording fluid has a relatively high viscosity or easily thickens. Other features will be apparent from the following detailed description when read in conjunction with the accompanying drawings.

BEST MODE FOR CARRYING OUT THE INVENTION

Figure 1:
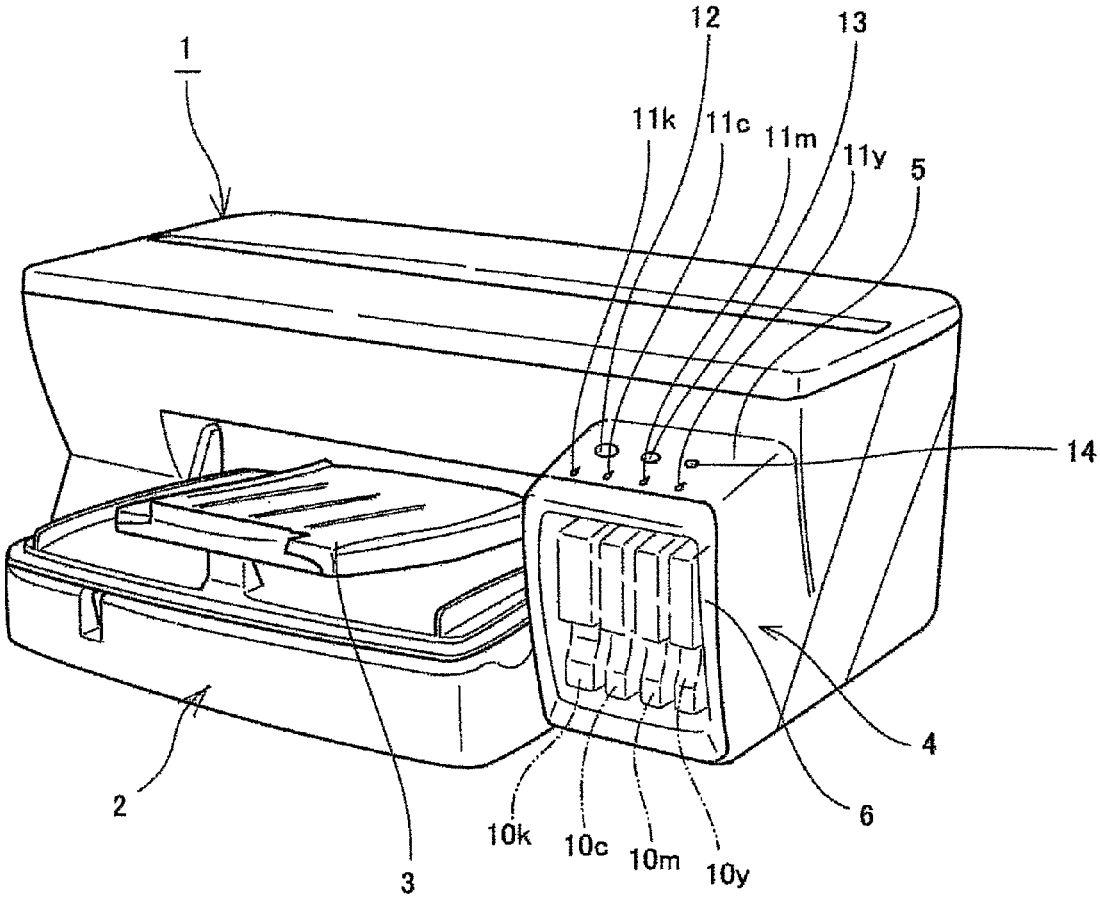
FIG. 1 is a perspective view of an embodiment of an image forming apparatus according to the present invention viewed from a front of the apparatus.

A description of examples and exemplary embodiments according to the present invention will be provided below with reference to FIGS. 1 through 14. FIG. 1 is a perspective view of an image forming apparatus, according to an exemplary embodiment of the present disclosure, viewed from a front of the apparatus.

The image forming apparatus includes a main apparatus body 1, a paper supply tray 2 for supplying recording media such as paper that are loaded into the main apparatus body 1, and a paper eject tray 3 on which the recording media such as paper that are recorded (formed) with images are stacked. The paper eject tray 3 is detachably provided on the main apparatus body 1. A cartridge loading part 4 is provided on one end on the front face of the main apparatus body 1, that is, on one side of the paper eject tray 3. The cartridge loading part 4 projects frontward from the front face of the main apparatus body 1, and has a top surface lower than the top surface of the main apparatus body 1. An operation and indicator part 5, including operation buttons and indicators, is provided on the top surface of the cartridge loading part 4.

Ink cartridges 10*k*, 10*c*, 10*m* and 10*y* respectively containing different colored recording ink, namely, black (K) ink, cyan (C) ink, magenta ink (M) and yellow (Y) ink, are replaceably loaded into the cartridge loading part 4. A front cover (cartridge cover) 6 that is provided at the front of the cartridge loading part 4 is opened when inserting an ink cartridge 10 into the cartridge loading part 4 from the front towards the rear of the main apparatus body 1. Each of the ink cartridges 10*k*, 10*c*, 10*m* and 10*y* is loaded in a vertical orientation and arranged along a horizontal direction.

The front cover 6 is made of a transparent or semitransparent material so that the ink cartridges 10*k*, 10*c*, 10*m* and 10*y* that are loaded into the cartridge loading part 4 are visible through the closed front cover 6. The front cover 6 may only be partially transparent or semitransparent, as long as the ink cartridges 10*k*, 10*c*, 10*m* and 10*y* that are loaded into the cartridge loading part 4 are visible through the closed front cover 6.

Remaining amount indicator parts 11*k*, 11*c*, 11*m* and 11*y* are provided in the operation and indicator part 5 at positions corresponding to the loaded positions of the ink cartridges 10*k*, 10*c*, 10*m* and 10*y*, to indicate that the remaining amount of the black (K), cyan (C), magenta (M) and yellow (Y) inks in the corresponding ink cartridges 10*k*, 10*c*, 10*m* and 10*y* is near the end or has reached the end (that is, the inks have almost run out or has run out). In addition, a power button 12, a paper supply and print resume button 13, and a cancel button 14 are also provided in the operation and indicator part 5.

Figure 2:
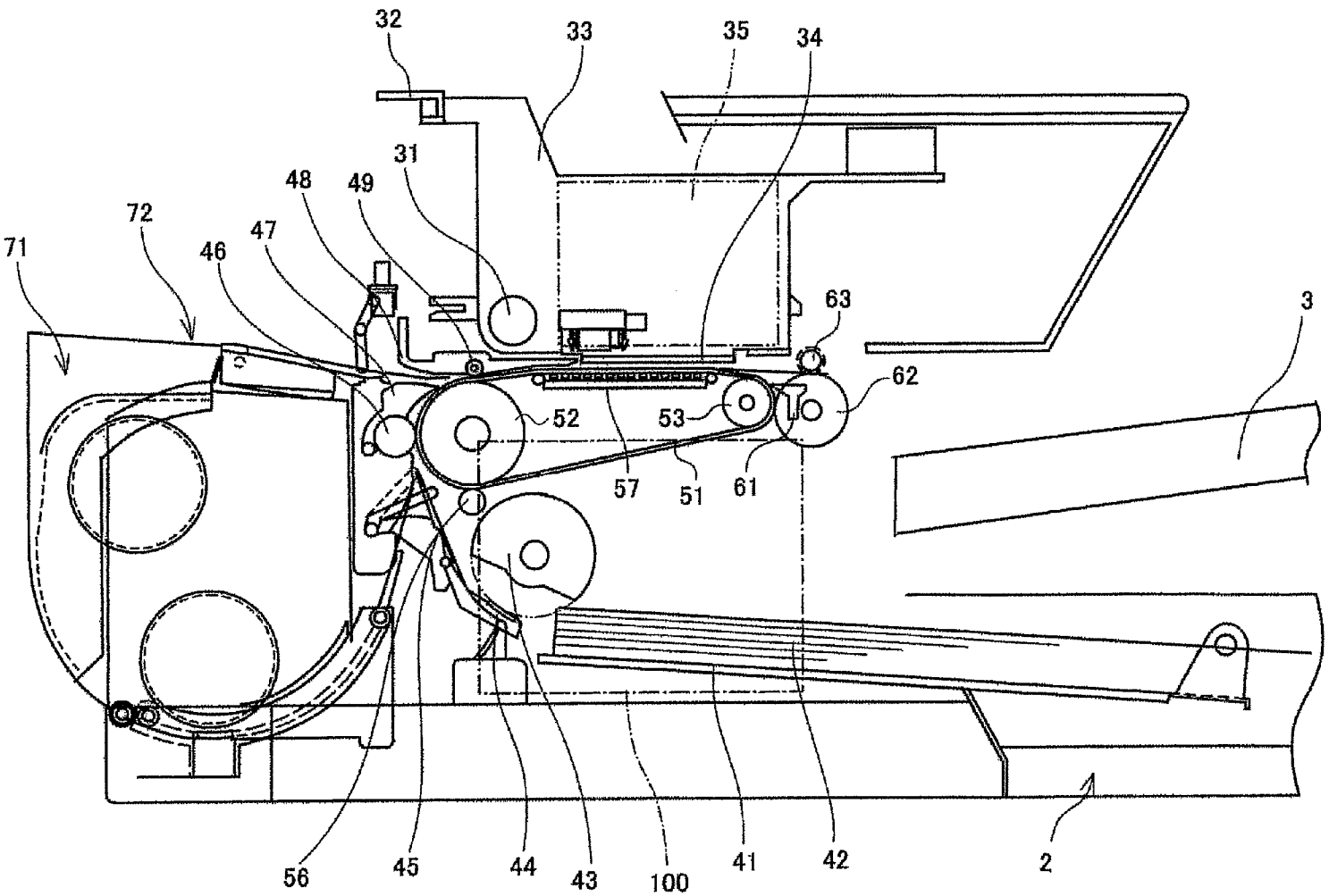
FIG. 2 is a side view in cross section showing a general structure of a mechanism part of the image forming apparatus.
Figure 3:
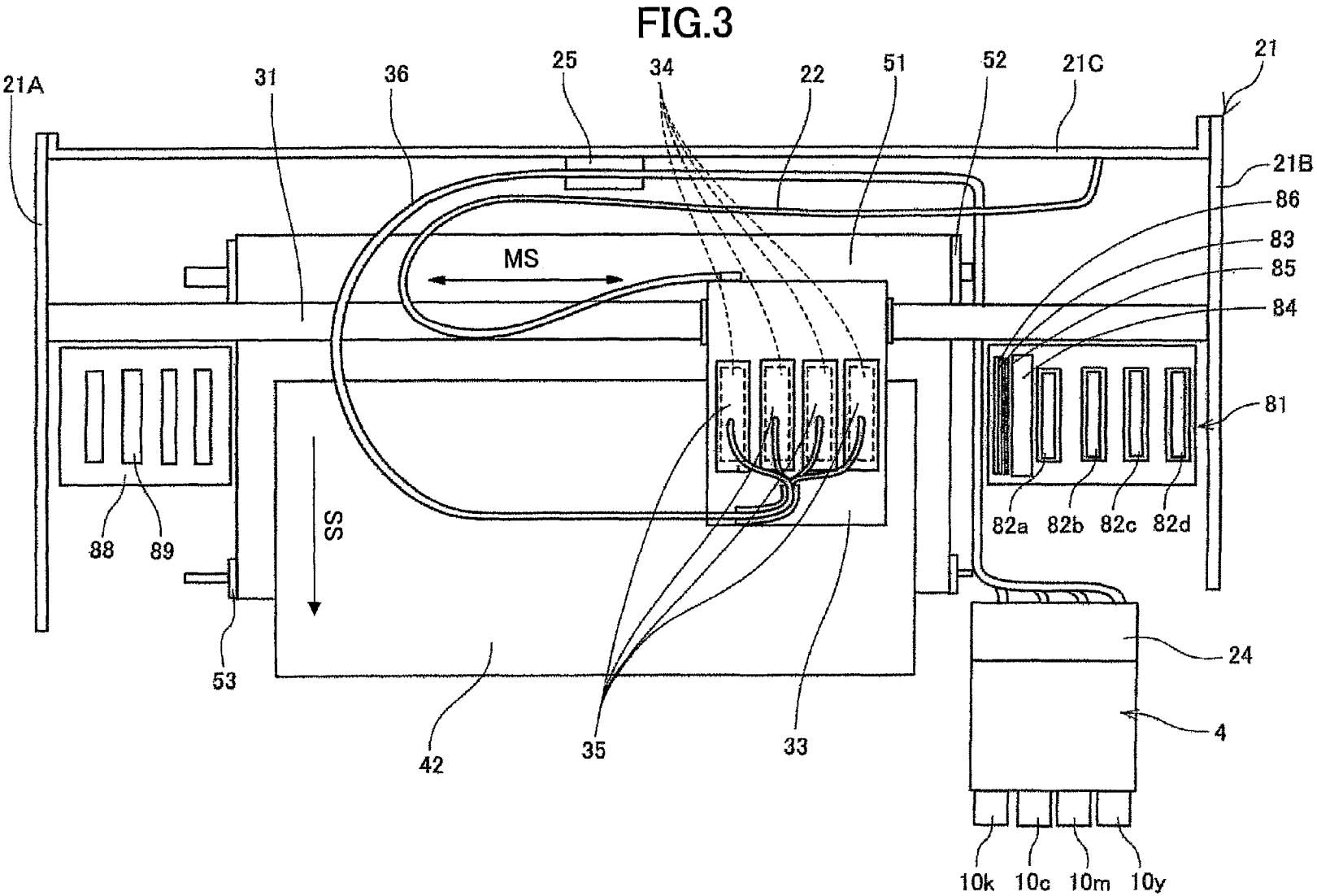
FIG. 3 is a plan view showing an important part of the mechanism part.

Next, a description will be given of a mechanism part of this image forming apparatus, by referring to FIGS. 2 and 3. FIG. 2 is a side view in cross section showing a general structure of the mechanism part of the image forming apparatus, and FIG. 3 is a plan view showing an important part of the mechanism part.

A frame 21 is formed by right and left side plates 21B and 21A. A carriage 33 is slidably supported by a guide rod 31 and a stay 32 that are provided between the side plates 21A and 21B, and is freely slidable in a main scanning direction. The carriage 33 is moved by a main scan motor (not shown) and carries out a scan in the main scanning direction indicated by an arrow MS in FIG. 3.

A recording head 34 is mounted on the carriage 33. The recording head 34 is made up of 4 ink-jet heads for respectively ejecting yellow (Y), cyan (C), magenta (M) and black (K) inks. Each ink-jet head has a plurality of nozzles that are arranged in a direction perpendicular to the main scanning direction. The recording head 34 is mounted at an orientation such that the nozzles of the ink-jet heads face downward, that is, the inks are ejected in the downward direction.

Each ink-jet head forming the recording head 34 is provided with a pressure generating means for generating a pressure to eject the ink from the nozzles as ink drops. The pressure generating means may be realized by a piezoelectric actuator such as a piezoelectric element, a thermal actuator that utilizes a phase change caused by a film boiling of the ink using an electrothermal conversion element such as a heating resistor, a shape memory alloy actuator that utilizes a metallic phase change caused by a temperature change, and an electrostatic actuator that utilizes electrostatic force.

The recording head 34 is provided with a driver IC (not shown) that is connected to a control part (not shown) via a harness (flexible printed cable) 22.

The carriage 33 is also provided with sub tanks 35 for supplying the yellow (Y), cyan (C), magenta (M) and black (K) inks to the recording head 34. The yellow (Y), cyan (C), magenta (M) and black (K) inks from the ink cartridges 10*y*, 10*c*, 10*m* and 10*k* that are loaded into the cartridge loading part 4 are supplied to the corresponding sub tanks 35 via corresponding ink supply tubes 36. A supply pump unit 24 for pumping the yellow (Y), cyan (C), magenta (M) and black (K) inks from the ink cartridges 10*y*, 10*c*, 10*m* and 10*k* to the corresponding sub tanks 35 is provided in the cartridge loading part 4. Intermediate portions of the ink supply tubes 36 are held by a holding member 25 which is provided on a rear plate 21C of the frame 21.

On the other hand, a paper supply part supplies paper 42 that is stacked on a paper stack part (pressure plate) 41 of the paper supply tray 2. The paper supply part includes a semicircular roller (paper supply roller) 43 for separating the stacked paper 42 stacked on the paper stack part 41, one by one, and supplying the separated paper 42, and a separation pad 44 that confronts the paper supply roller 43. The separation pad 44 is made of a material having a large coefficient of friction, and presses against the paper supply roller 43.

The paper 42 that is supplied from the paper supply part is transported by a transport means. The transport means includes a guide member 45 for guiding the paper 42, a counter roller 46, a transport guide member 47, a pushing member 48 having a tip end pressing roller 49, and a transport belt 51. The paper 42 is electrostatically adhered on the transport belt 51 and transported to a position confronting the recording head 34.

The transport means further includes a transport roller 52 and a tension roller 53. The transport belt 51 is formed by an endless belt that is provided between the transport roller 52 and the tension roller 53, and circulates in a belt transport direction (sub scanning direction) indicated by an arrow 55 in FIG. 3. The transport belt 51 may have a single-layer structure or multi-layer structure. In the case where the transport belt 51 has a multi-layer structure made up of two layers, namely, a first layer (or surface layer) and a second layer (or back layer), the first layer (or surface layer) may made of a pure resin material which has not been subjected to a resistance control and has a thickness on the order of approximately 40 μm, such as pure ETFE material, and the second layer (or intermediate resistance layer, ground layer) is made of the same material as the first layer but which has been subjected to a resistance control using carbon.

A charging roller 56 is provided as a charging means for charging the surface of the transport belt 51. The charging roller 56 is arranged so as to make contact with the surface layer of the transport belt 51 and rotate to follow the circulating movement of the transport belt 51. A predetermined pressure is applied on both ends of a shaft of the charging roller 56. The transport roller 52 also functions as a grounding roller, and makes contact with the back layer of the transport belt 51 to ground the back layer.

A guide member 57 is arranged on the back side of the transport belt 51 at a position corresponding to a recording region of the recording head 34. The top surface of the guide member 57 projects upwards from a tangent to the transport roller 52 and the tension roller 53 which support the transport belt 51, so as to maintain a highly flat surface of the transport roller 52.

The transport belt 51 is driven by a sub scan motor (not shown) via a driving belt (not shown) which drives the transport roller 52, for example. Hence, the transport belt 51 circulates in the belt transport direction (sub scanning direction).

A paper eject part is provided to eject the paper 42 that is recorded with an image by the recording head 34. The paper eject part includes a separation finger 61 for separating the paper 52 from the transport belt 51, and paper eject rollers 62 and 63. The paper eject tray 3 is provided under the paper eject roller 62. A distance from the paper eject tray 3 to a position between the paper eject rollers 62 and 63 is set to a certain value so that a relatively large amount of paper 3 may be stacked on the paper eject tray 3.

A duplex unit 71 is detachably provided on the rear part of the main apparatus body 1. The duplex unit 71 receives the paper 42 that is returned by a circulation of the transport belt 51 in a reverse direction, and reverses the side of the paper 42 before supplying the paper between the counter roller 46 and the transport belt 51. A manual feed tray 72 is provided on top of the duplex unit 71.

Furthermore, as shown in FIG. 3, a recovery mechanism 81 is provided in a non-recording region on one side of the main apparatus body 1 along the main scanning direction of the carriage 33. The recovery mechanism 81 is provided to maintain and to recover the normal state of the nozzles of the recording head 34.

The recovery mechanism 81 includes caps 82*a* through 82*d*, a wiper blade 83, a blank ejection receiver 84, a wiper cleaner 85, and a cleaner roller 86. The caps 82*a* through 82*d* respectively cap the nozzle surfaces of the corresponding ink-jet heads of the recording head 34. The wiper blade 83 wipes the nozzle surfaces. The blank ejection receiver 84 receives the ink drops when a blank ink ejection, which does not contribute to the recording, is made to eject the thickened recording ink. The wiper cleaner 85 removes the recording ink adhered on the wiper blade 83 to clean the wiper blade 83. The cleaner roller 86 pushes the wiper blade 83 against the wiper cleaner 85 when cleaning the wiper blade 83. The wiper blade 83, the wiper cleaner 85 and the cleaner roller 86 form a cleaning means.

The waste ink that is generated by the recovery process of the recovery mechanism 81, such as the ink ejected to the caps 82*a* through 82*d*, the ink that adheres on the wiper blade 83 and is removed by the wiper cleaner 85, and the ink that is ejected to the blank ejection receiver 84 by the blank ink ejection, is supplied to and contained in a waste tank or container 100 that is indicated by a one-dot chain line in FIG. 2.

In addition, a blank ejection receiver 88 is provided in a non-recording region on the other side of the main apparatus body 1 along the main scanning direction of the carriage 33. The blank ejection receiver 88 receives the ink drops when a blank ink ejection, which does not contribute to the recording, is made to eject the thickened recording ink during a recording or the like. The blank ejection receiver 88 has openings 89 which extend along the row of nozzles of the corresponding ink-jet heads of the recording head 34.

Figure 4:
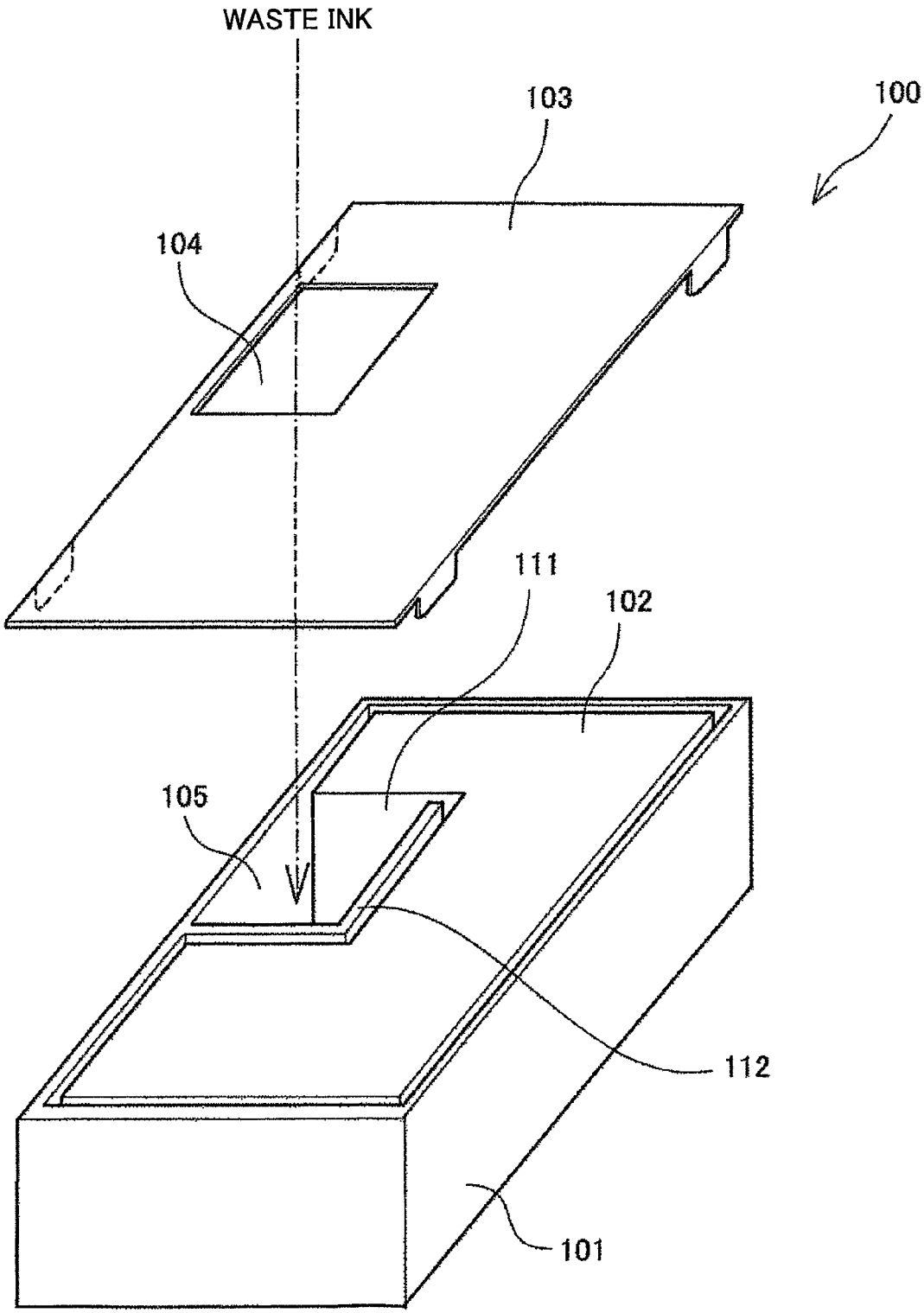
FIG. 4 is a disassembled perspective view showing a waste tank of the image forming apparatus.

Next, a description will be given of embodiments of the waste tank 100 of the image forming apparatus, by referring to FIGS. 4 through 7. FIG. 4 is a disassembled perspective view showing the waste tank 100 of the image forming apparatus, FIG. 5 is a perspective view showing the waste tank 100, FIG. 6 is a plan view showing the waste tank 100, and FIG. 7 is a diagram for explaining a full tank detecting device of the waste tank 100.

Figure 5:
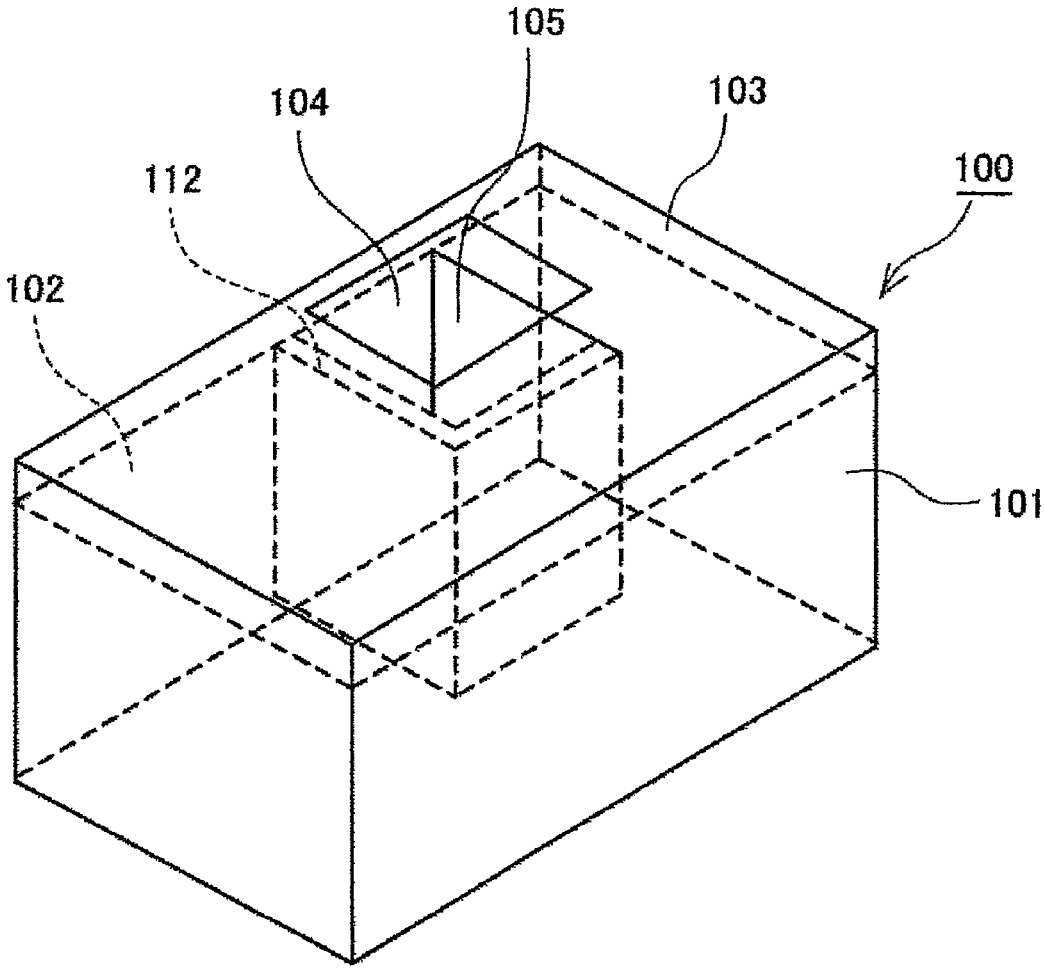
FIG. 5 is a perspective view showing the waste tank.
Figure 6:
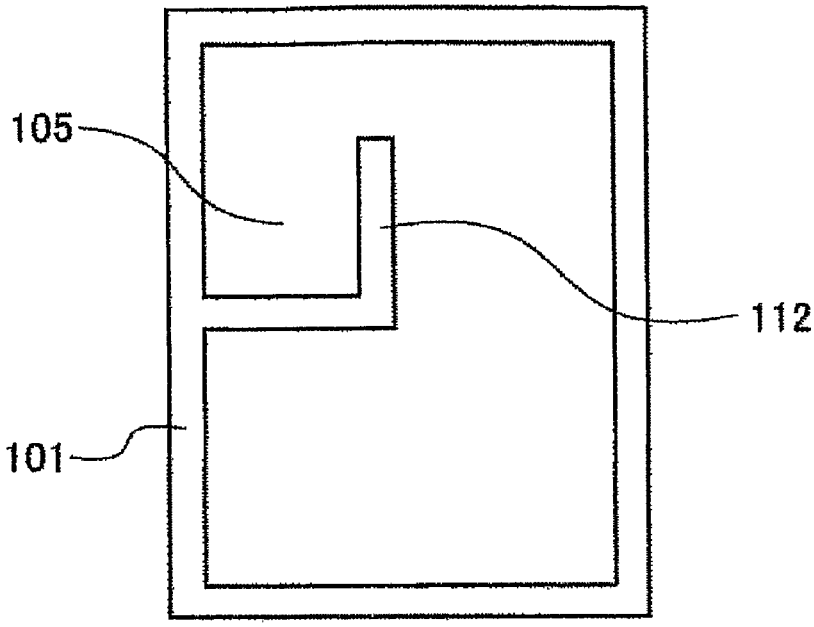
FIG. 6 is a plan view showing the waste tank.
Figure 7:
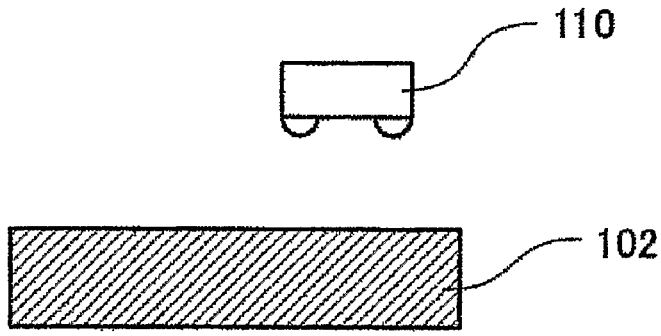
FIG. 7 is a diagram for explaining a full tank detecting device.

The waste tank shown in FIGS. 4 through 6 includes a main tank body (main container body) 101, an absorbing member (or body) 102 for absorbing the liquid waste ink contained in the main tank body 101, and a lid member 103 for covering the top of the main tank body 101.

The waste ink that is supplied from the recovery mechanism 81 reaches the inside of the waste tank 100 via a waste ink opening 104 that is provided in the lid member 103. A cutout 111 is formed in the absorbing member 102 at a position corresponding to the part where the waste ink is received via the waste ink opening 104, so as to form a space 105 that exposes the bottom surface of the main tank body 101. Hence, the waste ink received via the waste ink opening 104 does not reach the absorbing member 102 directly, and instead directly reaches the bottom surface of the main tank body 101 via the space 105. As a result, the waste ink having a high viscosity and a poor flowability can be deposited and contained within the space 105, while the waste ink having a sufficiently high flowability is absorbed by the absorbing member 102 via the space 105.

The space 105 is formed by a sidewall of the main tank body 101 and 3 sidewalls of the absorbing member 102, but in this embodiment, a partitioning wall member (or rib) 112 surrounds and covers two of the 3 sidewalls of the absorbing member 102 down to the bottom surface of the main tank body 101. The partitioning wall member 112 is integrally formed on the main tank body 101. Accordingly, only one of the 3 sidewalls of the absorbing member 102 is exposed to the space 105, and the waste ink having the sufficiently high flowability is absorbed by the absorbing member 102 only via the sidewall of the absorbing member 102 that is exposed to the space 105.

Furthermore, as will be described later, a full tank detection to detect the deposited state of the waste ink within the space 105 is made by software, but a full tank detection to detect the absorbed state of the absorbing member 102 that absorbs the waste ink is made by hardware. More particularly, a full tank sensor 110 shown in FIG. 7 that is made up of a reflection type photosensor is provided on the inner surface of the lid member 103, for example, so as to detect the absorbed state of the absorbing member 102 from a position separated from the space 105.

Figure 8:
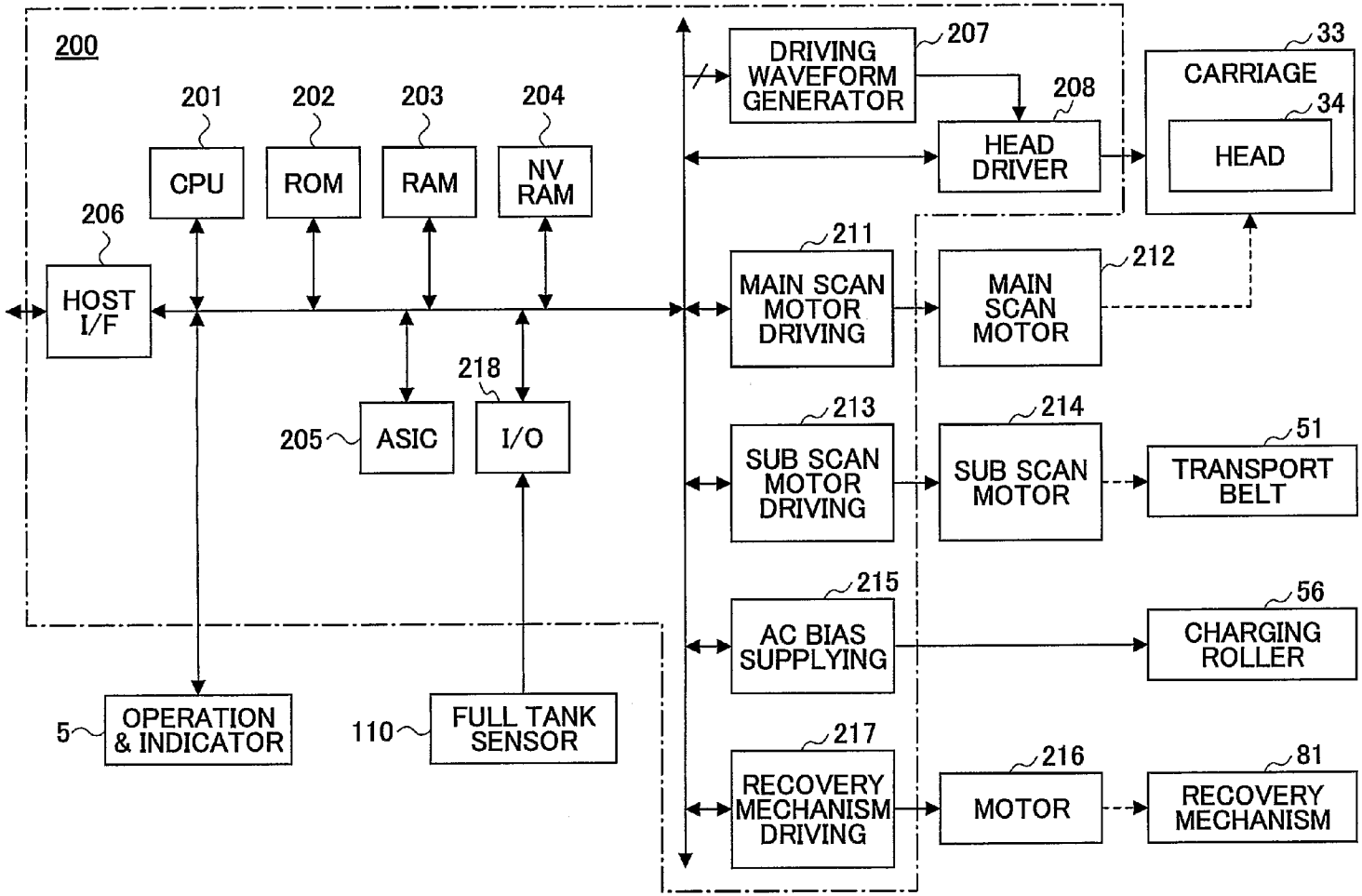
FIG. 8 is a system block diagram showing a general structure of a control part of the image forming apparatus.

Next, a description will be given of a general structure of the control part of the image forming apparatus, by referring to FIG. 8. FIG. 8 is a system block diagram showing the general structure of the control part of the image forming apparatus.

A control part 200 shown in FIG. 8 includes a CPU 201 that controls the entire image forming apparatus, a ROM 202 that stores programs to be executed by the CPU 201, a reference value that is used to judge the deposited state of the waste ink in the waste tank 100, driving waveform data and other fixed data, a RAM 203 that temporarily stores image data and the like, a non-volatile memory (NVRAM) 204 that holds data even when the power of the image forming apparatus is OFF, and an ASIC 205 that carries out various kinds of signal processing, image processing such as rearrangement, and other processing including processing of input and output signals for controlling the entire image forming apparatus.

The control part 200 further includes an interface (I/F) 206, a driving waveform generator 207, a head driver 208, a main scan motor driving part 211 for driving a main scan motor 212, a sub scan motor driving part 213 for driving a sub scan motor 214, an AC bias supplying part 215 for supplying an AC bias to the charging roller 56, a recovery mechanism driving part 217 for driving a motor 216 that drives a cam shaft for raising and lowering the caps 82*a* through 82*d* and drives a suction pump (not shown) of the recovery mechanism 81, and an input/output (I/O) part 218. The interface 206 exchanges data and signals between the control part 200 and a host unit (not shown), such as a personal computer. The driving waveform generator 207 generates a driving waveform for driving and controlling the recording head 34 via the head driver 208. The input/output part 218 inputs detection signals from various kinds of sensors (not shown) including a detection signal from the full tank sensor 110 which detects the full tank of the waste tank 100. An operation panel, including the operation and indicator part 5, is connected to the control part 200, so as to input and display information that is necessary to the image forming apparatus.

The control part 200 receives print data and the like, including image data, from the host unit, at the interface 206, via a cable or a network. The host unit may be made up of a personal computer or the like, and forms an image processing apparatus such as a data processing apparatus, an image reading apparatus such as an image scanner, and an image pickup apparatus such as a digital camera.

The CPU 201 reads and analyzes the print data within a reception buffer that is included in the interface 206, and after carrying out a data rearranging process and the like in the ASIC 205, transfers the image data to the head driver 208. The conversion of the print data to the bit-map data for the purpose of outputting the image may be carried out by a printer driver of the host unit, which develops the print data into the bit-map data and transfers the print data (bit-map data) from the host unit to the control part 200. However, it is of course possible to store font data in the ROM 202, for example.

The driving waveform generator 207 includes a digital-to-analog converter (DAC) for subjecting the pattern data of the driving pulses to a digital-to-analog conversion and outputting with respect to the head driver 208 a driving waveform that is made up of a single driving pulse (driving signal) or a plurality of driving pulses (driving signals).

The head driver 208 drives the recording head 34 by selectively applying the driving pulses forming the driving waveform that is received from the waveform generator 207 to the pressure generating means of the recording head 34, based on the serially input image data (dot pattern data) amounting to 1 line of the recording head 34.

In the image forming apparatus having the above described structure, the paper 42 in the paper supply tray 2 is separated and supplied one by one, and the paper 42 that is supplied upwards in an approximately vertical direction in FIG. 2 is guided by the guide member 45. The paper 42 is then transported between the transport belt 51 and the counter roller 46, and the tip end of the paper 42 is guided by the transport guide 37 and pushed against the transport belt 51 by the tip end pressing roller 49 so that the transport direction changes by approximately 90 degrees.

In this state, a control circuit (not shown) applies to the charging roller 56 the AC voltage from the AC bias supplying part 215 that alternately repeats a positive output and a negative output, so that the transport belt 51 is charged by alternating charge voltage patterns. In other words, the transport belt 51 is alternately charged in positive and negative polarity bands having a predetermined width, in the sub scanning direction (circulating direction). When the paper 42 is supplied onto the transport belt 51 that is alternately charged in the positive and negative polarity bands, the paper 42 electrostatically adheres on the transport belt 51 and is transported in the sub scanning direction as the transport belt 51 circulates in the circulating direction.

By driving the recording head 34 depending on the image signal while moving the carriage 33, the ink drops are ejected from the recording head 34 onto the stationary paper 42 to record 1 line. The next line is recorded in a similar manner after transporting the paper 42 a predetermined amount in the sub scanning direction. The recording operation ends in response to a recording end signal or a signal indicating that a rear end (or trailing end) of a recording region on the paper 42 is reached, and the recorded paper 42 is ejected to the paper eject tray 3.

In a recording standby state, the carriage 33 is moved to the recovery mechanism 81 and the caps 82*a* through 82*d* cap the nozzles of the recording head 34, so as to maintain the nozzles in a moist state and also prevent an ink ejection failure caused by dried ink. In the state where the caps 82*a* through 82*d* cap the nozzles of the recording head 34, a recovery process is carried out to draw out the recording inks from the nozzles by the suction pump, so as to eject the thickened recording inks and the air bubbles in the recording inks. In addition, at times such as before the start of the recording and during the recording, a blank ink ejection, which does not contribute to the recording, is made to eject the thickened recording ink. Accordingly, the recovery mechanism 81 can maintain and recover the stable (normal) ink-jet performance of the recording head 34.

The waste ink that is generated by the nozzle suction and the like of the recovery mechanism 81 is supplied to the waste tank 100 via waste ink tubes (not shown) that are connected to the suction pump (not shown).

Figure 9:
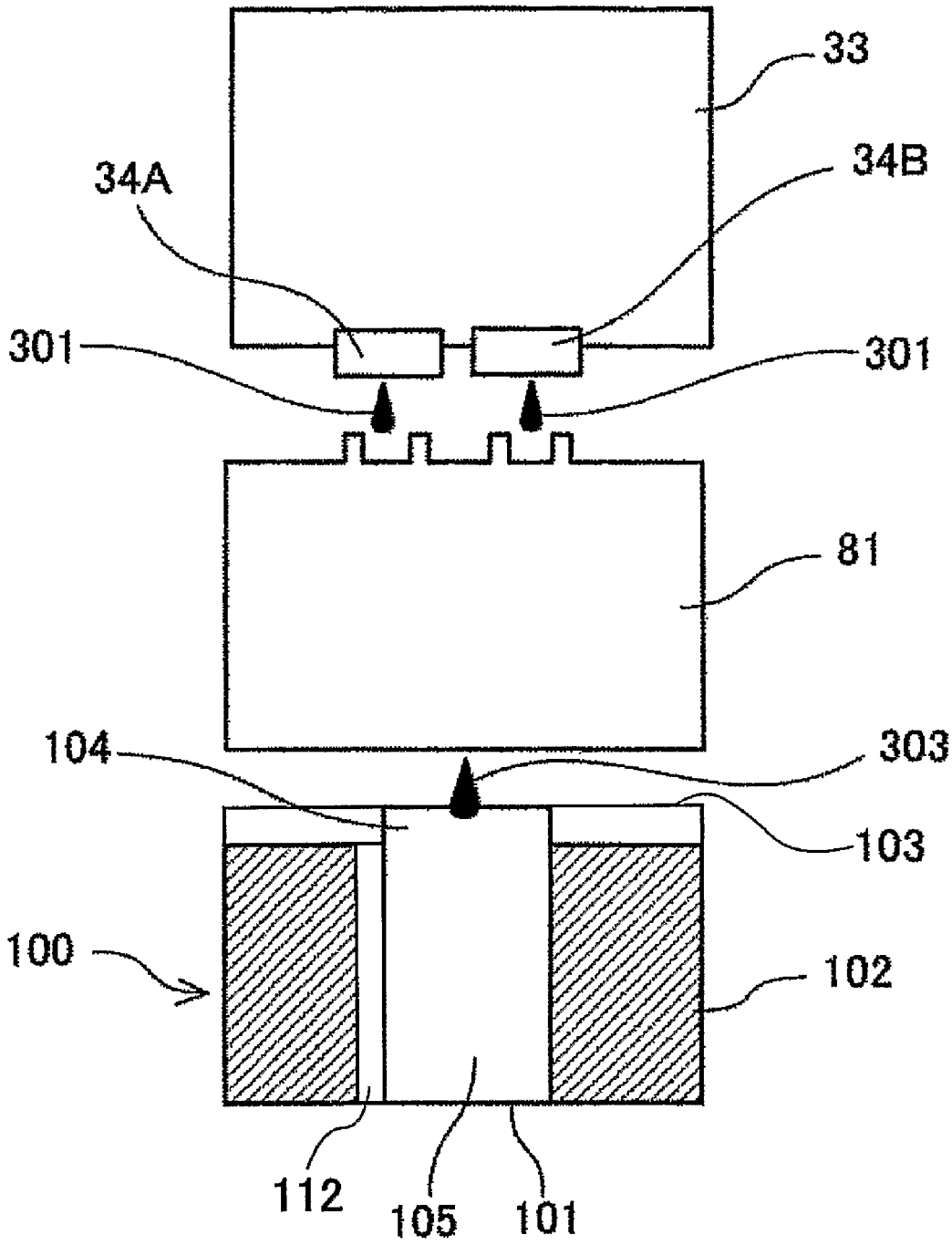
FIG. 9 is a diagram for explaining a supply of waste ink to the waste tank.

FIG. 9 is a diagram for explaining the supply of waste ink to the waste tank 100. In FIG. 9, only two ink-jet heads 34A and 34B of the recording head 34 are shown for the sake of convenience. As shown in FIG. 9, recording inks 301 from the ink-jet heads 34A and 34B are drawn out by suction into the corresponding caps 82 by the recovery process of the recovery mechanism 81, and a resulting waste ink 303 from the recovery mechanism 81 is supplied to a central portion of the space 105 within the waste tank 100 via the waste ink opening 104 in the lid member 103.

The waste ink 303 having virtually no flowability is deposited on the bottom surface of the main tank body 101 within the space 105. On the other hand, the waste ink 303 having a sufficiently high flowability is absorbed by the absorbing member 102 via the space 105.

Therefore, by forming the space 105 within the waste tank 100 and supplying the waste ink 303 directly to the bottom surface of the main tank body 101 within the space 105, the waste ink 303 or a portion thereof in liquid form having a sufficiently high flowability can be absorbed by the absorbing member 102, while the waste ink 303 or a portion thereof that is not in complete liquid form (due to thickening, for example) and having poor flowability can be gradually deposited within the space 105 on the bottom surface of the main tank body 101 without blocking the exposed surface of the absorbing member 102. Consequently, it is possible to suppress the ink absorbing capability of the absorbing member 102 from deteriorating prematurely, and the absorbing member 102 can continue to efficiently absorb the waste ink 303. The absorbing member 102 is made of a porous material or the like that has a sufficiently high absorptivity for satisfactorily absorbing the waste ink 303 or a portion thereof in the liquid form having the sufficiently high flowability.

The use of the pigment-based recording ink is extremely advantageous from the point of view of improving the picture quality of the image that is recorded on the recording medium such as paper. However, when the liquid component of the pigment-based recording ink is developed, the viscosity of the pigment-based recording ink increases rapidly, and the pigment-based recording ink thickens to behave almost like a solid. For this reason, if the pigment-based recording ink is supplied directly on the absorbing member within the waste tank, the pigment-based recording ink may become deposited on the spot and may cause the pigment-based recording ink to overflow prematurely from the waste ink opening of the waste tank.

On the other hand, by providing a space having no absorbing member within the waste tank and supplying the waste ink directly on the bottom surface of the main tank body within the space, the waste ink or a portion thereof in liquid form having a sufficiently high flowability can be absorbed by the absorbing member, while the waste ink or a portion thereof that is not in complete liquid form (due to thickening of the pigment-based recording ink, for example) and having poor flowability can be gradually deposited within the space on the bottom surface of the main tank body without blocking the exposed surface of the absorbing member. As a result, it is possible to prevent the premature overflow of the waste ink from the waste ink opening in the waste tank due to the waste ink deposit, and simultaneously improve the recovery or containment of the waste ink by the space and the absorbing member.

Particularly in the case of the pigment-based recording ink that includes a water-dispersible coloring agent, a wetting agent and a penetrating agent, with a viscosity increase rate due to moisture evaporation that is 1.0 or less up to a moisture evaporation rate of 30% with respect to the total weight of the ink and is 50 or greater for moisture evaporation rates of higher than 30% and less than or equal to 45%, it is important to provide the waste tank 100 described above since such a pigment-based recording ink easily makes a deposit within the waste tank 100.

According to experiments conducted by the present inventors, it was found that when containing such a pigment-based recording ink within the waste tank 100, both the space 105 and the absorbing member 102 can be utilized efficiently if the volume ratios of the space 105 within the waste tank 100 and the absorbing member 102 is in a range of 1:4 to 3:2.

Figure 10:
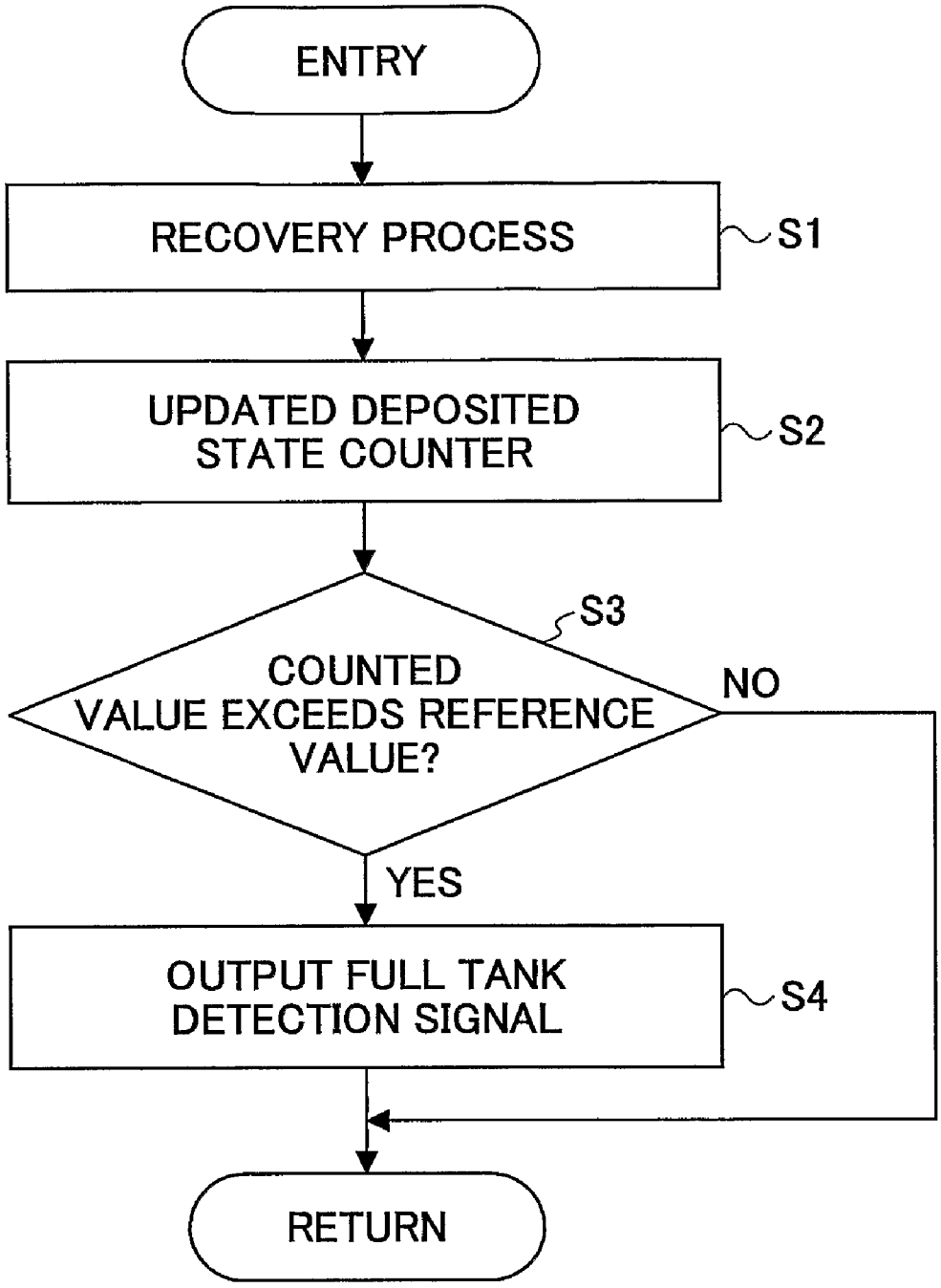
FIG. 10 is a flow chart for explaining a full tank detection process.

Next, a description will be given of a full tank detection process to detect that the full tank of the waste tank 100 is reached due to the deposited state of the waste ink within the space 105, by referring to FIG. 10. FIG. 10 is a flow chart for explaining the full tank detection process.

In this embodiment, a number of times the recovery process is carried out is regarded as a correlation value which has a correlation to the deposited state of the waste ink in the space 105 within the waste tank 100. A deposited state counter is provided to count, by software, the number of times the recovery process is carried out.

As shown in FIG. 10, the control part 200 updates the deposited state counter (step S2) when the recovery process is carried out by the recovery mechanism 81 (step S1), and judges whether or not the counted value of the deposited state counter exceeds a predetermined reference value (step S3). If the counted value of the deposited state counter does not exceed the reference value (NO in step S3), it is judged that the deposited state of the waste ink in the space 105 within the waste tank 100 is such that the waste tank 100 is not full, and the process returns to a main routine, for example. On the other hand, if the counted value of the deposited state counter exceeds the reference value (YES in step S3), it is judged that the deposited state of the waste ink in the space 105 within the waste tank 100 is such that the waste tank 100 is full, and a full tank detection signal is output to indicate that the waste tank 100 is full (step S4), and the process returns to the main routine, for example.

Therefore, by providing the waste tank with the space for containing the waste ink, a means for obtaining the correlation value having the correlation to the deposited state of the waste ink in the space within the waste tank, and a means for judging whether or not the correlation value exceeds the predetermined reference value, it is possible to realize a highly reliable image forming apparatus since the premature overflow of the waste ink from the waste tank caused by the deposit of the waste ink is prevented, and the waste tank can be used efficiently.

In addition, by providing the absorbing member for absorbing and holding the waste ink in the waste tank together with the space in which the waste ink may be deposited, and the full tank sensor 110 for detecting the full tank, that is, the fully absorbed state of the absorbing member 102, it is possible to realize an even more highly reliable image forming apparatus since the premature overflow of the waste ink from the waste tank caused by the deposit of the waste ink is prevented, and the fully absorbed state (or waste ink leak) of the absorbing member 102 can be positively detected.

As described above, the recovery process maintains and recovers the ink-jet performance of the recording head. More particularly, there are various kinds of recovery processes, including blank ink ejection (or auxiliary ink ejection) that does not contribute to the recording, head suction that draws out the ink from the nozzles of the recording head by suction, wiping that wipes the nozzle surface of the recording head by the wiper blade or the like, and combinations of at least two of such operations. For example, the image forming apparatus described above carries out the recovery process that includes cleaning (a series of operations including the head suction, wiping and blank ink ejection), atmospheric release (a combination of supplying the ink to the sub tank, head suction and cleaning), and refreshing (a combination of head suction to suck an amount of ink greater than that by cleaning, and cleaning).

Of the various kinds of recovery processes, the head suction ejects a relatively large amount of waste ink. Hence, in this embodiment, the deposited state counter is incremented by 1 every time the head suction is carried out once, for example, regardless of the amount of ejected ink. Hence, it is possible to monitor the deposited state of the waste ink while maintaining the required memory capacity for storing the counted value of the deposited state counter to small memory capacity. The counted value of the deposited state counter is stored in a rewritable nonvolatile memory so that the counted value will not be erased even when the power of the image forming apparatus is turned OFF.

By using the number of times the recovery process is carried out to eject from the recording head the recording ink that does not contribute to the recording, as the correlation value that is correlated to the deposited state of the waste ink in the space within the waste tank, it is possible to judge that the waste tank has become full by the deposit of the waste ink in the space by a relatively simple process.

The reference value is determined by the ink containable volume of the space within the waste tank, and can thus be set to a fixed value. If the volume ratios of the space 105 within the waste tank 100 and the absorbing member 102 is in the range of 1:4 to 3:2 as described above, the present inventors have confirmed that the full tank caused by the filled space 105 and the full tank caused by the fully absorbed absorbing member 102 occur at timings that are not substantially different. Hence, the full tank can be detected satisfactorily in such a case even if the reference value is set to a fixed value.

Of course, instead of setting the reference value to a fixed value, the reference value may be changed in correlation to the rate at which the deposit of the waste ink progresses. In other words, because differences are introduced in the drying state of the waste ink depending on the frequency with which the waste ink is ejected, it is also effective to change the reference value depending on the waste ink ejection frequency.

More particularly, since the drying of the waste ink accelerates and the flowability deteriorates when the waste ink ejection frequency is low, the deposit of the waste ink progresses more easily even when the amount of ejected waste ink is relatively large. On the other hand, when the waste ink ejection frequency is high, there are tendencies for the drying of the waste ink to uneasily progress and the deposit of the waste ink to uneasily progress.

Figures 11, 12:
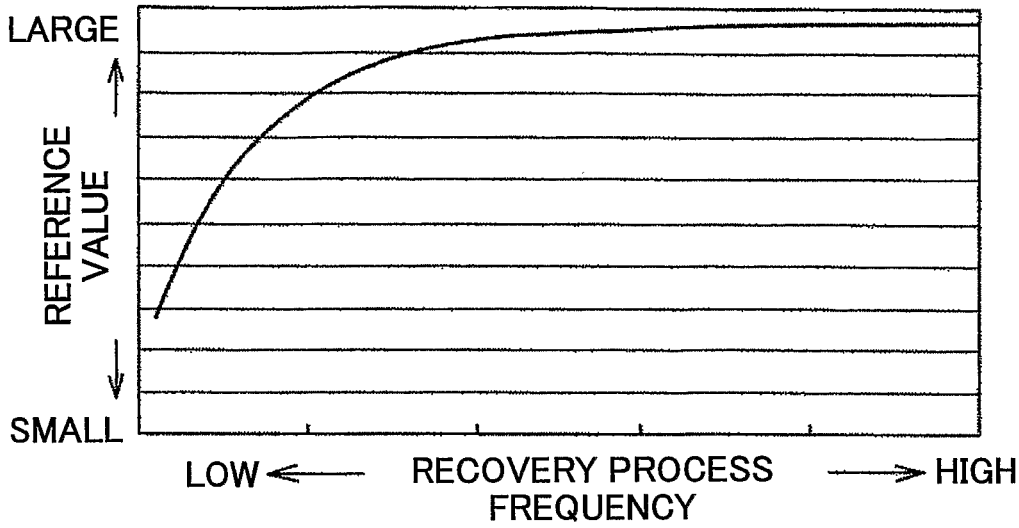
FIG. 11 is a diagram showing a relationship of a recovery process frequency and a reference value.
FIG. 12 is a diagram showing particular examples of the relationship of the recovery process frequency and the reference value.

Accordingly, it is possible to appropriately set the reference value depending on the rate at which the deposit of the waste ink progresses, by obtaining the recovery process frequency corresponding to the waste ink ejection frequency, and changing the reference value to a small value when the recovery process frequency is low since the relative deposit progression rate of the waste ink becomes faster, and to a large value when the recovery process frequency is high since the relative deposit progression rate of the waste ink becomes slower, as shown in FIG. 11. FIG. 11 is a diagram showing a relationship of the recovery process frequency and the reference value. Hence, it is possible to prevent the overflow of the waste ink from the waste tank due to the deposit of the waste ink and to efficiently utilize the waste tank by changing the reference value depending on the recovery process frequency.

Of course, the method of calculating the waste ink ejection frequency is not limited to the above, and may be obtained by other methods, such as dividing the counted value of the deposited state counter by the total used time of the waste tank. In other words, the waste ink ejection frequency may be obtained by calculating (total number of recovery processes)/(elapsed time). For example, the total used time of the waste tank (that is, elapsed time) may be obtained as follows. If the waste tank is replaced within the service life of the image forming apparatus, the total used time of the waste tank may be calculated from {(present date and time)-(replaced date of waste tank)}. On the other hand, if the waste tank is not replaced within the service life of the image forming apparatus, the total used time of the waste tank may be calculated from {(present date and time)-(date when the operation of the image forming apparatus is started)}.

The elapsed time includes the time when the power of the image forming apparatus is not ON. More particularly, in the case where the waste tank has not been replaced, the initial start time of the image forming apparatus is stored, and the elapsed time can be obtained from a difference between the initial start time and the present time when the waste tank is replaced. In the case where the waste tank is replaced, the time (replaced time) when the waste tank is replaced is stored, and the elapsed time can be obtained from a difference between the replaced time and the present time. Preferably, the waste ink ejection frequency and the counted value of the deposited state counter are obtained at a timing immediately after the waste ink is ejected, that is, at a time when the recovery process ends.

FIG. 12 is a diagram showing particular examples of the relationship of the recovery process frequency and the reference value, for a case C1 where the reference value is constant and for a case C2 where the reference value is changed depending on the waste ink ejection frequency. In the case C1, the reference value is set to 1000 regardless of the recovery process frequency. On the other hand, in the case C2, the reference value changes from 500 to 1500 depending on the recovery process frequency. Of course, the reference value is not limited to the values shown in FIG. 12.

Figures 13, 14:
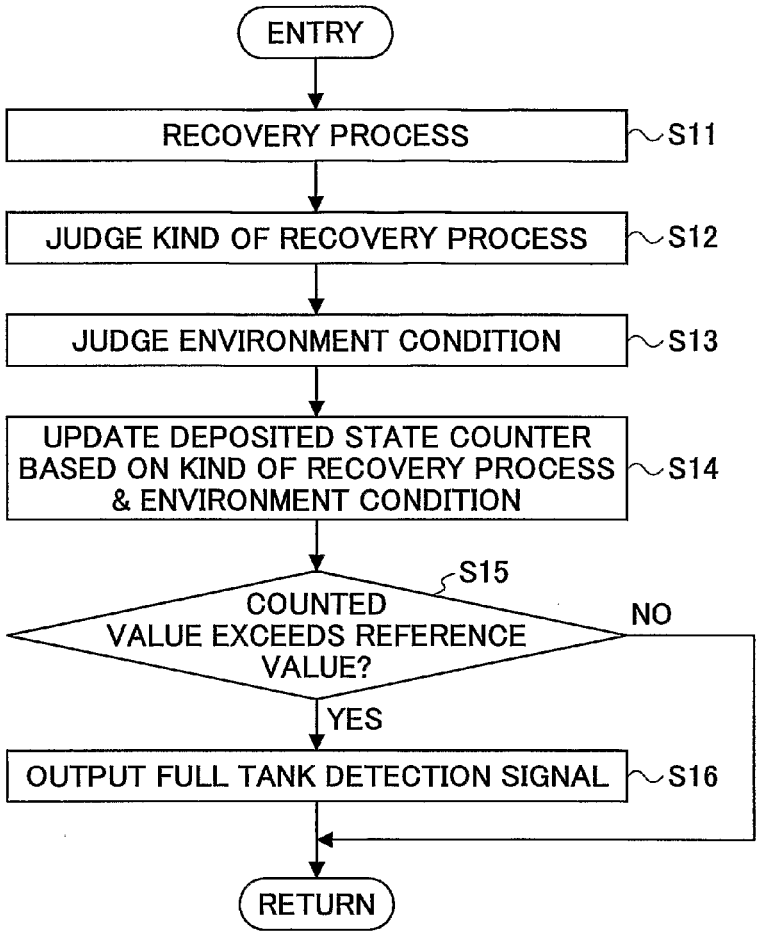
FIG. 13 is a flow chart for explaining another full tank detection process.
FIG. 14 is a diagram for explaining a counted value of a deposited state counter with respect to various kinds of recovery processes and environmental conditions.

Next, a description will be given of another full tank detection process to detect that the full tank of the waste tank 100 is reached due to the deposited state of the waste ink within the space 105, by referring to FIG. 13. FIG. 13 is a flow chart for explaining this other full tank detection process.

As shown in FIG. 13, the control part 200 judges the kind of recovery process (step S12) when the recovery process is carried out by the recovery mechanism 81 (step S11). Then, after judging the environment condition (step S13), the control part 200 updates the deposited state counter depending on the kind of recovery process and the environment condition (step S14). A judgement is made to determine whether or not the counted value of the deposited state counter exceeds a reference value (step S15). If the counted value of the deposited state counter does not exceed the reference value (NO in step S15), it is judged that the deposited state of the waste ink in the space 105 within the waste tank 100 is such that the waste tank 100 is not full, and the process returns to a main routine, for example. On the other hand, if the counted value of the deposited state counter exceeds the reference value (YES in step S15), it is judged that the deposited state of the waste ink in the space 105 within the waste tank 100 is such that the waste tank 100 is full, and a full tank detection signal is output to indicate that the waste tank 100 is full (step S16), and the process returns to the main routine, for example.

Accordingly, the counted value of the deposited state counter is corrected depending on the kind of recovery process and the environment condition. In other words, the extent of the deposit of the waste ink in the space 105 within the waste tank 100 is affected by the flowability of the waste ink or the viscosity of the waste ink. FIG. 14 is a diagram for explaining the counted value of the deposited state counter with respect to various kinds of recovery processes and environmental conditions. As shown in FIG. 14, the relative extent of the deposit of the waste ink is larger for the low humidity condition than the high humidity condition since the viscosity of the waste ink is higher for the low humidity condition. In addition, the relative extent of the deposit of the waste ink is larger for the high temperature condition than the low temperature condition because the drying of the waste ink progresses faster for the high temperature condition.

Hence, by setting an adding value that is to be added to the counted value of the deposited state counter depending on the environment condition and updating the counted value of the deposited state counter by the corresponding adding value depending on the environment condition that is obtained from the judgement result, it is possible to more accurately detect the deposited state of the waste ink in the space within the waste tank. For this reason, it is possible to more positively prevent the overflow of the waste ink from the waste tank due to the deposit of the waste ink and to more efficiently utilize the waste tank.

As described above, there are various kinds of recovery processes that eject different amounts of waste ink. Thus, by setting the adding value that is to be added to the counted value of the deposited state counter depending on the kind of recovery process and updating the counted value of the deposited state counter by the corresponding adding value depending on the kind of recovery process that is obtained from the judgement result, it is possible to more accurately detect the deposited state of the waste ink in the space within the waste tank. For this reason, it is possible to more positively prevent the overflow of the waste ink from the waste tank due to the deposit of the waste ink and to more efficiently utilize the waste tank.

FIG. 14 shows a case where the environment condition is categorized into 4 kinds, namely, low temperature and low humidity condition, low temperature and high humidity condition, high temperature and low humidity condition, and high temperature and high humidity condition, and the recovery process is categorized into 3 kinds, namely, a recovery process RA having a relatively small amount of ink ejection, a recovery process RB having a medium amount of ink ejection, and a recovery process RC having a large amount of ink ejection. An adding value is set with respect to each pair of environment condition and recovery process.

In each of the full tank detection processes described above, the full tank detection signal is output to indicate that the waste tank 100 is full when the counted value of the deposited state counter exceeds the reference value. Hence, an indication to indicate the full state of the waste tank 100 may be displayed on the host unit and/or in the operation and indicator part 5 of the image forming apparatus, based on the full tank detection signal. It is also possible to prohibit the use of the image forming apparatus or, to display a message permitting the use of the image forming apparatus under a limited condition so as to maintain the usable state of the image forming apparatus, when making this display to indicate the full state of the waste tank 100. In the latter case, the limited condition may limit the amount of waste ink that is ejected, limit the time for which the image forming apparatus may be used, or the like. When the time for which the image forming apparatus may be used is limited, the operability of the image forming apparatus is improved because the user is given an opportunity to replace the waste tank 100 before the use of the image forming apparatus becomes prohibited.

In the embodiment described above, the space within the waste tank has a rectangular column shape, but the shape of the space is not limited to such. Similarly, the shape of the waste ink opening in the lid member of the waste tank is also not limited to that of the embodiment described above. In addition, it is possible to expose the absorbing member at more than one of the sidewalls defining the space. Moreover, the number of sidewalls defining the space and the number of sidewalls exposing the absorbing member vary depending on the shape of the space, for example. Furthermore, one or more sidewalls defining the space may partially expose the absorbing member instead of fully exposing the absorbing member as in the case of the embodiment described above.

Moreover, in the embodiment described above, the present invention is applied to the ink-jet recording apparatus or printer. However, application of the present invention is not limited to a printer, and the present invention may be applied to various image forming apparatuses, such as a composite (or multi-function) apparatuses having the functions of the printer, facsimile apparatus and copying apparatus. The present invention is also applicable to image forming apparatuses that use a liquid or fluid other than ink, such as a recording fluid and a fixer or fixing solution.

This application claims the benefit of a Japanese Patent Application No.2004-350713 filed Dec. 3, 2004, in the Japanese Patent Office, the disclosure of which is hereby incorporated by reference.

Further, the present invention is not limited to examples and exemplary embodiments, but various variations and modifications may be made without departing from the scope of the present disclosure and the appended claims.

The invention claimed is:

1. An image forming apparatus for forming an image on a recording medium by ejecting drops of recording fluid from a recording head, comprising:

a waste tank having a space for containing waste fluid;

obtaining means for obtaining a correlation value that has a correlation to a deposited state of the waste fluid in the space within the waste tank; and judging means for judging whether or not the correlation value exceeds a reference value, wherein the reference value is changed based on a recovery process frequency at which the recovery process is carried out.

2. The image forming apparatus as claimed in claim 1, wherein the obtaining means obtains the correlation value from a number of times a recovery process is carried out to eject from the recording head recording fluid that does not contribute to image formation.

3. The image forming apparatus as claimed in claim 1, wherein the waste tank includes an absorbing member for absorbing and holding the waste fluid, and detection means for detecting a fully absorbed state of the absorbing member.

4. The image forming apparatus as claimed in claim 3, wherein a volume ratio of the space and the absorbing member within the waste tank is in a range of 1:4 to 3:2.

5. The image forming apparatus as claimed in claim 1, wherein the recovery process frequency is obtained based on a total number of recovery processes carried out during a total used time of the waste tank.

6. The image forming apparatus as claimed in claim 1, wherein the reference value is constant.

7. The image forming apparatus as claimed claim 1, wherein a usable state of the image forming apparatus is limited when the correlation value exceeds the reference value.

8. The image forming apparatus as claimed in claim 1, wherein the recording fluid includes a water-dispersible coloring agent, a wetting agent and a penetrating agent, and has a viscosity increase rate due to moisture evaporation that is 1.0 or less up to a moisture evaporation rate of 30% with respect to a total weight of the recording fluid and is 50 or greater for moisture evaporation razes of higher than 30% and less than or equal to 45%.

9. An image forming apparatus for forming an image on a recording medium by ejecting drops of recording fluid from a recording head, comprising:

a waste tank having a space for containing waste fluid;

obtaining means for obtaining a correlation value that has a correlation to a deposited state of the waste fluid in the space within the waste tank; and judging means for judging whether or not the correlation value exceeds a reference value, wherein the correlation value is corrected depending on an environment condition and wherein the reference value is changed based on a recovery process frequency at which the recovery process is carried out.

10. The image forming apparatus as claimed in claim 9, wherein a usable state of the image forming apparatus is limited when the correlation value exceeds the reference value.

11. The image farming apparatus as claimed in claim 9, wherein the recording fluid includes a water-dispersible coloring agent, a wetting agent and a penetrating agent, and has a viscosity increase, rate due to moisture evaporation that is 1.0 or less up to a moisture evaporation rate of 30% with respect to a total weight of the recording fluid and is 50 or greater for moisture evaporation rates of higher than 30% and less than or equal to 45%.

* * * * *